US007453249B2

(12) United States Patent
Lenz et al.

(10) Patent No.: US 7,453,249 B2
(45) Date of Patent: Nov. 18, 2008

(54) METHOD FOR CONTROLLING THE OPERATION OF A LOW-DROPOUT VOLTAGE REGULATOR AND CORRESPONDING INTEGRATED CIRCUIT

(75) Inventors: Kuno Lenz, Voreppe (FR); Claude Renous, Grenoble (FR); Jean-Luc Patry, Crolles (FR)

(73) Assignee: STMicroelectronics SA, Montrouge (FR)

( * ) Notice: Subject to any disclaimer, the term of this patent is extended or adjusted under 35 U.S.C. 154(b) by 477 days.

(21) Appl. No.: 11/166,765

(22) Filed: Jun. 24, 2005

(65) Prior Publication Data

US 2006/0006857 A1 Jan. 12, 2006

(30) Foreign Application Priority Data

Jun. 24, 2004 (FR) ..... 04 06883

(51) Int. Cl.
*G05F 1/40* (2006.01)
*G05F 1/56* (2006.01)

(52) U.S. Cl. ..... 323/288; 323/282

(58) Field of Classification Search ..... 323/268, 323/270, 271, 273, 274, 282, 284, 288, 280
See application file for complete search history.

(56) References Cited

U.S. PATENT DOCUMENTS

| | | | | |
|---|---|---|---|---|
| 8,252,385 | | 6/2001 | Mellot | |
| 6,373,233 | B2 * | 4/2002 | Bakker et al. | 323/282 |
| 6,445,167 | B1 | 9/2002 | Marty | |
| 6,690,147 | B2 * | 2/2004 | Bonto | 323/280 |
| 6,933,710 | B2 * | 8/2005 | Shieh | 323/282 |
| 7,030,677 | B2 * | 4/2006 | Pannwitz | 327/314 |
| 7,173,402 | B2 * | 2/2007 | Chen et al. | 323/280 |
| 7,205,827 | B2 * | 4/2007 | Leung et al. | 327/540 |
| 7,235,959 | B2 * | 6/2007 | Sicard | 323/316 |
| 2003/0090279 | A1 | 5/2003 | Garcia et al. | |

FOREIGN PATENT DOCUMENTS

| | | |
|---|---|---|
| EP | 0 971 280 | 1/2000 |

OTHER PUBLICATIONS

French Preliminary Search Report dated Jan. 6, 2005 for French Application No. 04 06883.

* cited by examiner

*Primary Examiner*—Matthew V Nguyen
(74) *Attorney, Agent, or Firm*—Lisa K. Jorgenson; Jon A. Gibbons; Fleit Gibbons Gutman Bongini & Bianco P.L.

(57) ABSTRACT

An integrated circuit including at least one low-dropout voltage regulator (LDO) capable of delivering a regulated output voltage using a reference voltage (VREF), comprises means for generating a substitution voltage (VRMP) in the form of a ramp and control means capable of replacing the reference voltage (VREF) by the substitution voltage as long as the substitution voltage (VRMP) is lower than the reference voltage (VREF).

16 Claims, 5 Drawing Sheets

METHOD FOR CONTROLLING THE OPERATION OF A LOW-DROPOUT VOLTAGE REGULATOR AND CORRESPONDING INTEGRATED CIRCUIT

CROSS-REFERENCE TO RELATED APPLICATIONS

This application is based upon and claims priority from prior French Patent Application No. 04 06883, filed on Jun. 24, 2004, the entire disclosure of which is herein incorporated by reference.

FIELD OF THE INVENTION

The present invention generally relates to low-dropout (LDO) voltage regulators and, more particularly, the control of voltage regulators in the start-up phase.

BACKGROUND OF THE INVENTION

A voltage regulator uses a reference current source and a power supply voltage (battery) in order to deliver a regulated output voltage, in other words a voltage that is independent of the variations in the power supply voltage and of the variations in load, i.e. in the current drawn.

LDO voltage regulators are particularly suitable where there are small variations in the power supply voltage. For stability, LDO voltage regulators can be connected to an external capacitor mounted in parallel with the load to be supplied by the regulated voltage. When the LDO voltage regulator is turned on, the external capacitor is generally charged up by a relatively high charge current.

Now, this charge current may cause a voltage drop across the power supply battery, especially where several voltage regulators are connected together across the same power supply battery. Presently, the charge current is limited by generating a current that is the image of the charge current, then comparing this image current with a reference current. However, the limit must be high enough so as not to interfere with the operation of the voltage regulator. This drawback is accentuated by the fact that the image current is not very precise.

Furthermore, if the start-up of each voltage regulator is to be staggered in order to prevent the drop in voltage of the power supply battery, it then becomes necessary to study in detail the whole circuit in order to precisely define the order in which the various regulators are to be turned on. In addition, the interconnections between the various loads may lead to the appearance of interference-causing currents due to conducting parasitic diodes associated with the various levels of the output voltages of the various regulators during their start-up phase.

Accordingly, what is needed is a method and system to overcome the problems encountered in the prior art and to provide a method and system to prevent a voltage drop across a power supply during startup.

SUMMARY OF THE INVENTION

Briefly, in accordance with the present invention is a solution overcome the problem with voltage drop across a power supply during start-up. The solution includes a method allowing the start-up phase of an LDO voltage regulator to be controlled in order to prevent a voltage drop across a power supply battery. The present invention allows the simultaneous start-up of several LDO voltage regulators connected across a same power supply battery.

Accordingly, in one embodiment the present invention provides a method for controlling the operation of an LDO voltage regulator capable of delivering a regulated output voltage using a reference voltage. The method comprises a start-up phase for the regulator in which the reference voltage is replaced by a substitution voltage in the form of a ramp, as long as the value of this substitution voltage remains below the reference voltage.

Also, according to the present invention, the charge current in the external capacitor can be limited by means of the slope of the substitution voltage ramp.

Another aspect of the invention is an integrated circuit comprising at least one LDO voltage regulator capable of delivering a regulated output voltage using a reference voltage. This circuit advantageously comprises means for generating a substitution voltage in the form of a ramp and control means capable of replacing the reference voltage by the substitution voltage as long as the said substitution voltage is lower than the said reference voltage.

According to one embodiment in which the regulator output is connected to a load across which an external capacitor is connected in parallel, the slope of the said voltage ramp can be advantageously chosen as a function of a desired current in the external capacitor during the start-up phase.

According to another embodiment, in which the regulator comprises a main operational amplifier having a first input (for example the positive input), receiving the reference voltage, and an output fed back into a second input (for example the negative input) of the main operational amplifier via a control transistor, the control means comprise an auxiliary operational amplifier having a first input (for example the positive input), connected to the output of the generating means, a second input (for example the negative input) connected to the second input of the main operational amplifier and an output connected to the output of the main amplifier and to the gate of the control transistor.

According to another embodiment, in which the regulator comprises a main operational amplifier having a first input (for example the positive input) receiving the reference voltage, and an output fed back into a second input (for example the negative input) of the main operational amplifier via a control transistor, the control means comprise a comparator capable of comparing the substitution voltage and the reference voltage and a switch, connected to the first input of the main operational amplifier, capable of delivering either the substitution voltage or the reference voltage, depending on the output signal delivered by the comparator.

According to another embodiment in which the regulator comprises a main operational amplifier comprising a first input transistor receiving the reference voltage at its gate, the control means comprise an additional transistor mounted in parallel with the first input transistor of the main operational amplifier and receiving the substitution voltage at its gate.

According to the embodiments envisaged, the main operational amplifier advantageously comprises two PMOS or NMOS input transistors.

According to one embodiment, the integrated circuit comprises several regulators with their associated control means, with their outputs respectively connected to several loads, and the generation means are connected to all the regulator-control means assemblies.

Thus, by controlling the regulators with the same ramp at start-up, driving parasitic diodes into conduction is avoided.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention will be apparent from the following detailed description taken in conjunction with the accompanying drawings in which:

DESCRIPTION OF THE PREFERRED EMBODIMENTS

It should be understood that these embodiments are only examples of the many advantageous uses of the innovative teachings herein. In general, statements made in the specification of the present application do not necessarily limit any of the various claimed inventions. Moreover, some statements may apply to some inventive features but not to others. In general, unless otherwise indicated, singular elements may be in the plural and vice versa with no loss of generality.

Figure 1:
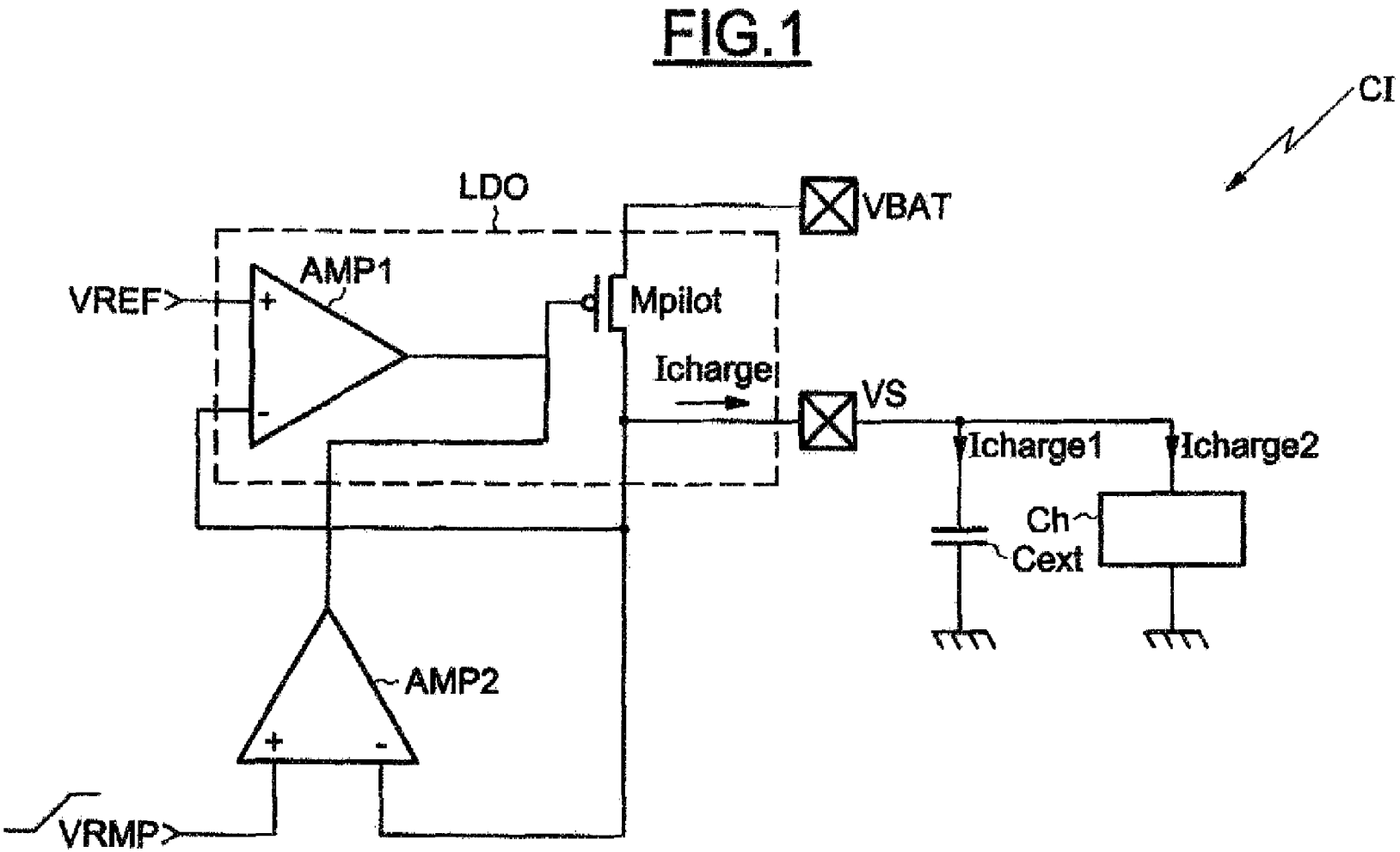
FIG. 1 shows schematically a first exemplary embodiment of a circuit according to the present invention.

An integrated circuit CI according to the invention is shown in FIG. 1.

The reference LDO represents a low-dropout voltage regulator. It comprises a main operational amplifier AMP1 receiving a reference voltage $V_{REF}$ at the positive input.

The regulator LDO also comprises a control transistor Mpilot connected by its gate to the output of the amplifier AMP1. The transistor Mpilot, and therefore the regulator LDO, is supplied with a power supply voltage $V_{BAT}$ delivered by a battery (not shown). The drain of the transistor Mpilot, delivering the regulated output voltage $V_s$, is fed back into the negative input of the main operational amplifier AMP1.

The output of the regulator LDO is connected to a load Ch and to an external capacitor Cext.

The external capacitor Cext generally has a fairly high capacitance, for example 4.7 μF. Its role is to stabilize the low-dropout voltage regulator LDO.

Aside from the regulator LDO, the integrated circuit Cl comprises control means that comprises an auxiliary operational amplifier AMP2. The auxiliary operational amplifier AMP2 receives a substitution voltage VRMP in the form of a ramp at its positive input. The voltage VRMP is generated by means known per se, comprising for example a voltage source. The negative input of the auxiliary operational amplifier AMP2 is connected to the output of the control transistor Mpilot. Thus, the output voltage VS of the regulator LDO follows the voltage VRMP.

The output of the auxiliary operational amplifier AMP2 is connected to the main operational amplifier AMP1 such that, during the start-up phase of the regulator LDO, the control means replaces the reference voltage VREF with the substitution voltage VRMP as long as the substitution voltage VRMP is lower than the reference voltage VREF. This process will be seen in more detail below.

When the regulator LDO is turned on, the substitution voltage $V_{RMP}$ is reset to 0 V. Subsequently, it rises according to a predetermined ramp.

The charge current $I_{charge}$, delivered by the control transistor Mpilot, is then proportional to the slope of the ramp of the substitution voltage $V_{RMP}$. Indeed, the slope of the ramp is calculated such that the current $I_{charge1}$ flowing in the external capacitor Cext is small. It can, for example, be equivalent to 10% of the charge current $I_{charge2}$ flowing in the load Ch. Thus, if a current $I_{charge2}$ equal to 100 mA were desired, then $I_{charge1}$ would be 10 mA.

$I_{charge1}$ can be obtained by the equation:

$$I_{charge1}=(C*U)/t,$$

with C, the capacitance of the external capacitor Cext, U, the voltage across the terminals of the capacitor Cext which is equal to $V_S$, and t, the time.

By fixing the slope of the ramp of the substitution voltage $V_{RMP}$, given by the equation $I_{charge1}C=U/t$, where $U=V_S$, the desired current $I_{charge1}$ can therefore be obtained.

Thus, by choosing a suitable slope, a current $I_{charge1}$ can be obtained that is low enough not to cause a voltage drop at the power supply battery.

Figure 2:
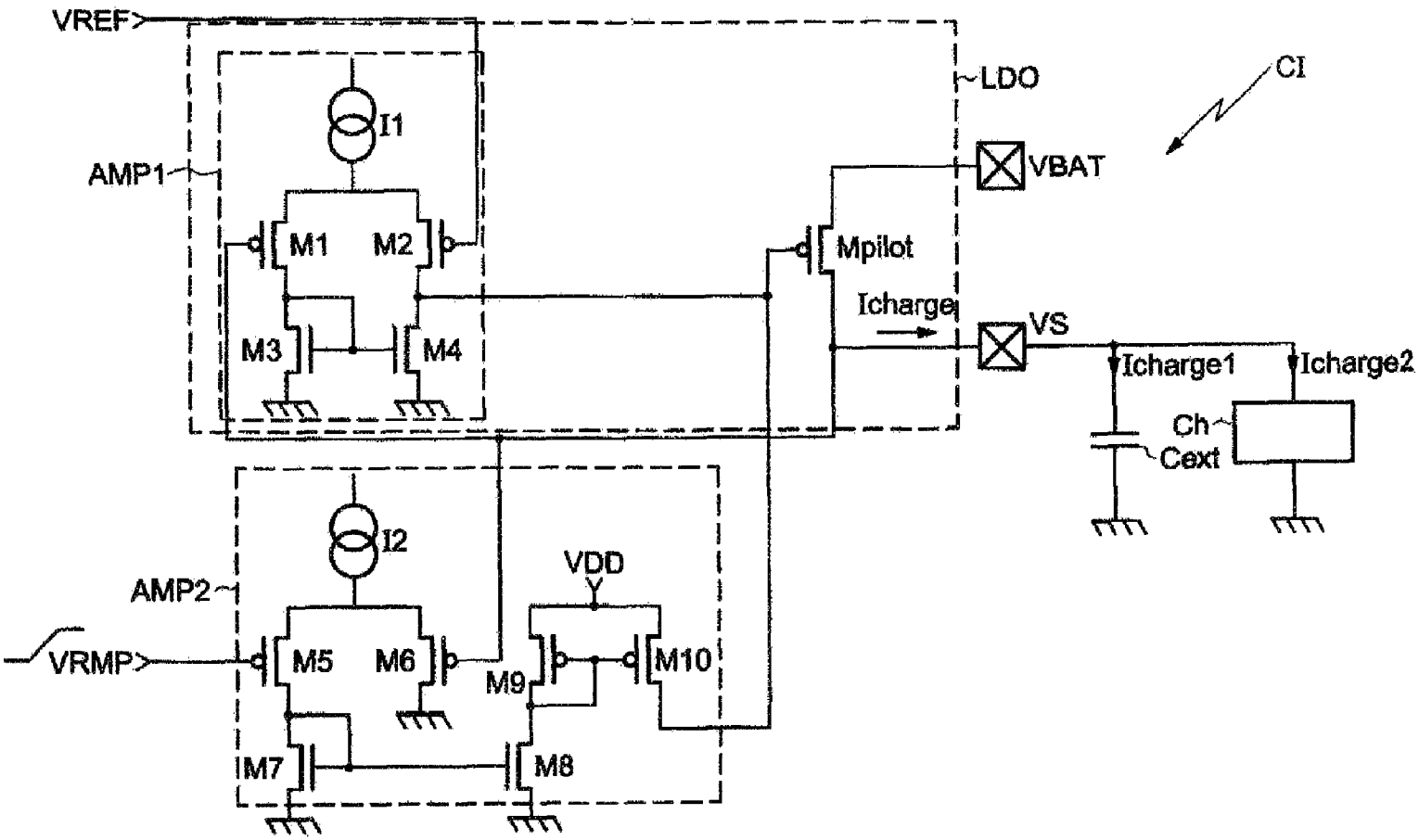
FIG. 2 shows schematically, but in more detail, certain parts of FIG. 1, according to the present invention.

FIG. 2 describes the main and auxiliary operational amplifiers, AMP1 and AMP2 respectively, together with the operation of the control means, in more detail.

The main operational amplifier AMP1 comprises two input transistors M1 and M2 configured as a differential pair. A common node links the sources of the two transistors M1 and M2. A current source I1 is also connected to the common node.

The main operational amplifier AMP1 also has a current mirror formed by the transistors M3 and M4. The gates of the transistors M3 and M4 are connected together. The gate of the transistor M3 is fed back into its source. In addition, the drains of the transistors M3 and M4 are connected to ground and their sources are connected to the drains of the transistors of the differential pair M1 and M2. The source of the transistor M4 is also connected to the gate of the control transistor Mpilot.

The auxiliary operational amplifier AMP2 comprises a first current mirror formed by two transistors M9 and M10. The drain of the transistor M10 is connected to the gate of the control transistor Mpilot and to the output of the main operational amplifier AMP1. A common node links the gates of the transistors M9 and M10. The gate of M9 is also fed back into its drain.

The transistors M9 and M10 are supplied by the power supply voltage VDD, to which they are connected via their sources.

The drain of the transistor M9 is connected to a first transistor M8 of a first differential pair of the auxiliary operational amplifier AMP2. The gate of the transistor M8 is connected to that of the second transistor M7 of the first differential pair. Their sources are connected to ground. The gate of the transistor M7 is also fed back into its drain.

The auxiliary operational amplifier AMP2 comprises a second differential pair composed of the transistors M5 and M6. Another common node links their sources. A current source 12 is also connected to the other common node. The drain of M5 is connected to the source of the transistor M7 and its gate receives the substitution voltage $V_{RMP}$; it corresponds to the positive input of the operational amplifier AMP2. The gate of the transistor M6 is connected to the gate of the transistor M1 of the main operational amplifier AMP1; it corresponds to the negative input of the auxiliary amplifier AMP2.

During the start-up phase of the regulator LDO, when the output voltage VS is less than the reference voltage VREF, the transistor M2 is off and the transistor M4 delivers a constant current equal to that of the current source I1. The transistors M1, M3 and M4 of the main operational amplifier AMP1 operate as a current source. The transistor M4 delivers the necessary current to the transistor M10 of the auxiliary operational amplifier AMP2.

The transistors M5, M6, M7, M8, M9 and M10 operate as an error amplifier. The output voltage $V_S$ of the control transistor Mpilot can then follow the substitution voltage $V_{RMP}$.

When the substitution voltage $V_{RMP}$ reaches the value defined by the equation $V_{RMP}=V_{REF}+V_{GS}$, with $V_{GS}$ the voltage between the gate and the source of the transistor M2, the transistor M2 starts to conduct the current. The output voltage Vs no longer follows the substitution voltage $V_{RMP}$. During this phase where $V_{RMP}=V_{REF}\pm V_{GS}$, the two operational amplifiers, namely the main one AMP1 and the auxiliary one AMP2, operate as two followers in parallel.

When $V_{RMP}$ becomes higher than $V_{REF}+V_{GS}$, all the current I2 flows through the transistor M6 and the transistors M5, M7, M8, M9, M10 are turned off. The current delivered by M10 is zero. Only the transistors M1, M2, M3 and M4 of the operational amplifier AMP1 are active.

Figure 3:
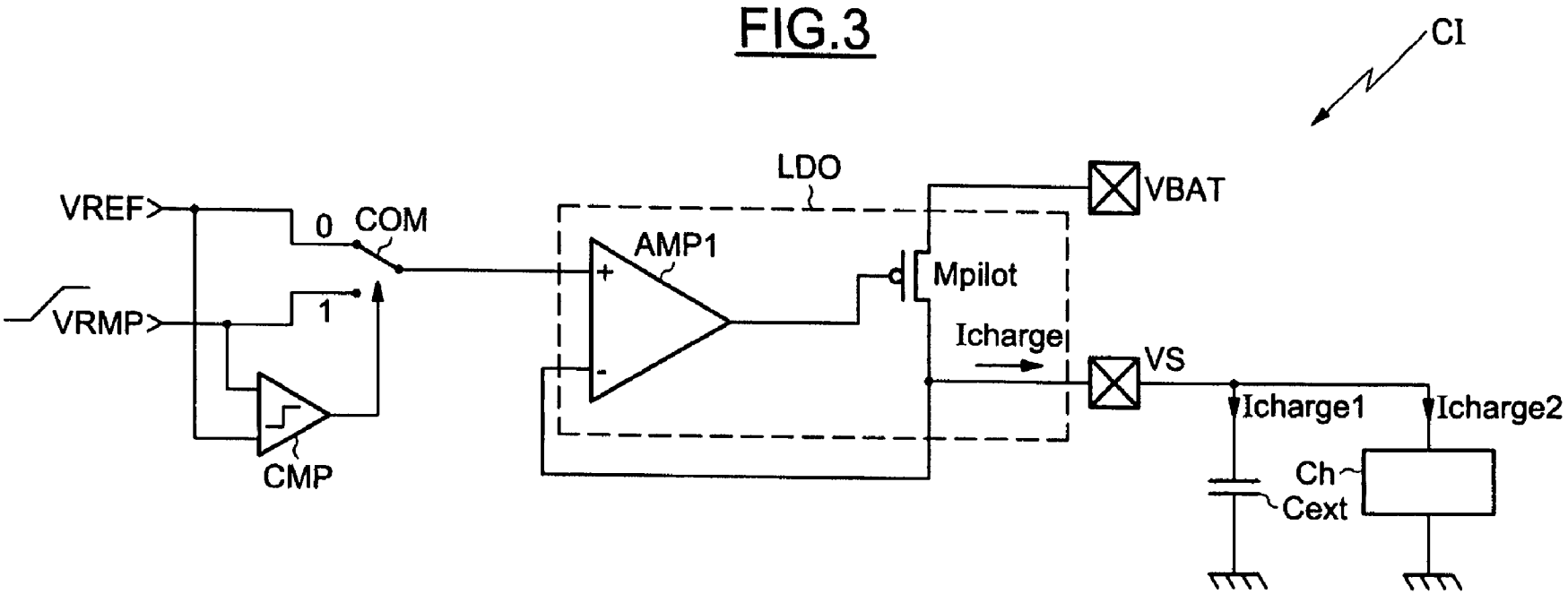
FIG. 3 shows schematically another exemplary embodiment of a circuit according to the present invention.

A variant of the control device for the voltage regulator can be seen in FIG. 3. For this configuration, the control means comprise a switch COM and a comparator CMP.

The positive input of the main operational amplifier AMP1 is connected to the switch COM.

The switch COM is controlled by the output of the comparator CMP which performs a comparison between the reference voltage $V_{REF}$ and the substitution voltage $V_{RMP}$.

As long as the substitution voltage $V_{RMP}$ is below the reference voltage $V_{REF}$, the comparator CMP delivers the value "1", and the switch COM connects the positive input of the main operational amplifier AMP1 to the substitution voltage $V_{RMP}$. Otherwise, the comparator CMP delivers the value "0" and the switch COM connects the positive input of the main operational amplifier AMP1 to the reference voltage $V_{REF}$.

Figure 4:
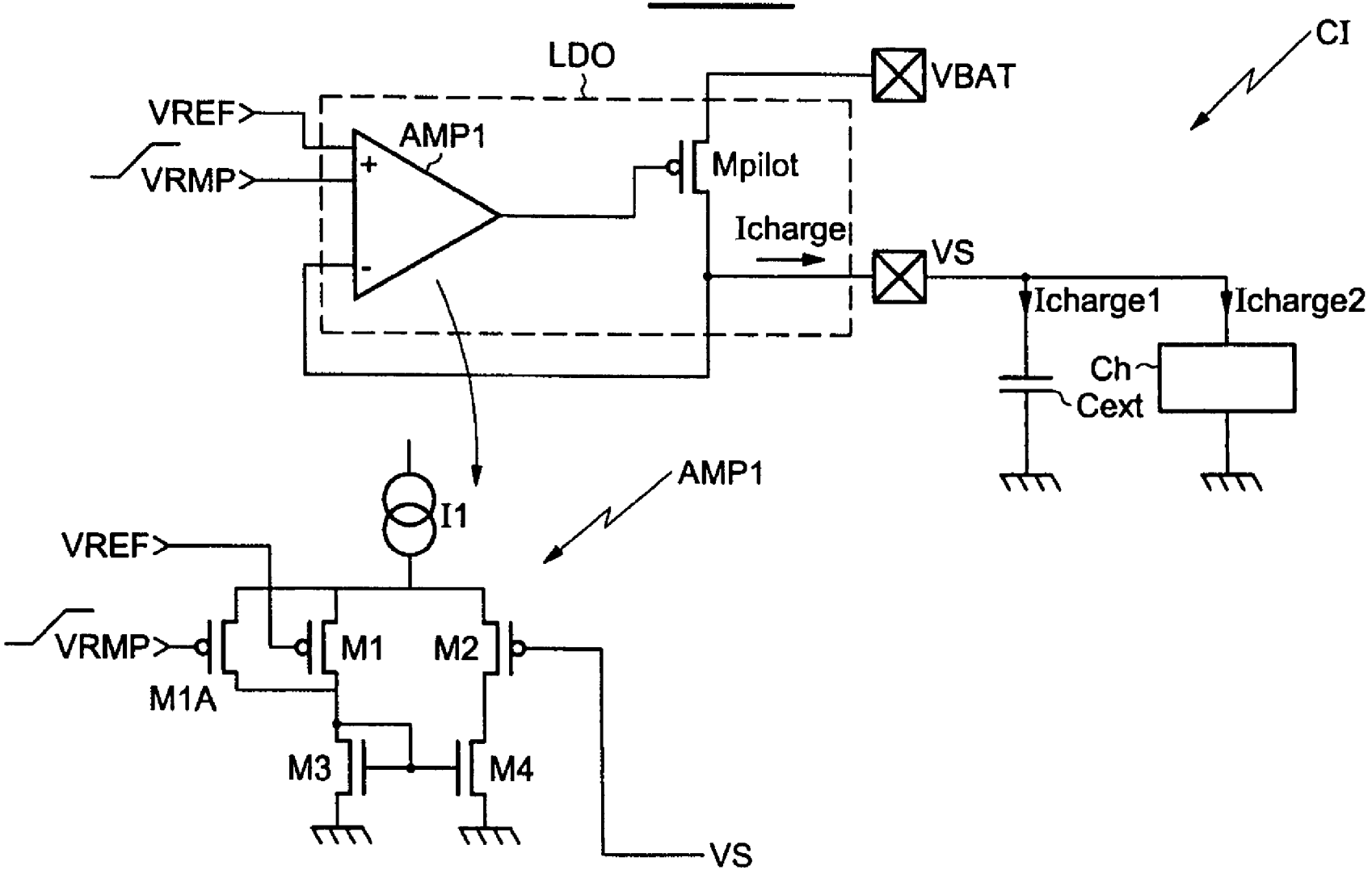
FIG. 4 shows schematically a further exemplary embodiment of a circuit according to the present invention.

FIG. 4 shows another variant of the control means. Aside from the differential pair M1, M2 and the current mirror M3 and M4, the main operational amplifier AMP1 comprises an additional transistor M1A connected in parallel with the transistor M1 of the differential pair. This additional transistor M1A forms part of the control means of the regulator LDO. The additional transistor M1A receives the substitution voltage $V_{RMP}$ at its gate. The transistor M1 receives the reference voltage $V_{REF}$ at its gate.

The gate of the transistor M2 is connected to the output of the control transistor Mpilot.

When the additional transistor M1A is conducting, in other words when not in the phase where $V_{RMP}$ is higher than $V_{REF}+V_{GS}$, then the output voltage $V_S$ of the control transistor Mpilot follows the substitution voltage VRMP. Otherwise, the additional transistor M1A is turned off and the transistor M1 conducts.

The transistors used for the input transistors M1 and M2 of the main operational amplifier AMP1 are PMOS transistors for the variants shown in FIGS. 3 and 4. Indeed, the main operational amplifier AMP1 must be operational at the beginning of the start-up phase, when the substitution voltage $V_{RMP}$ is equal to 0 V. For the configuration shown in FIGS. 1 and 2, the transistors M1 and M2 can be NMOS transistors.

Figure 5:
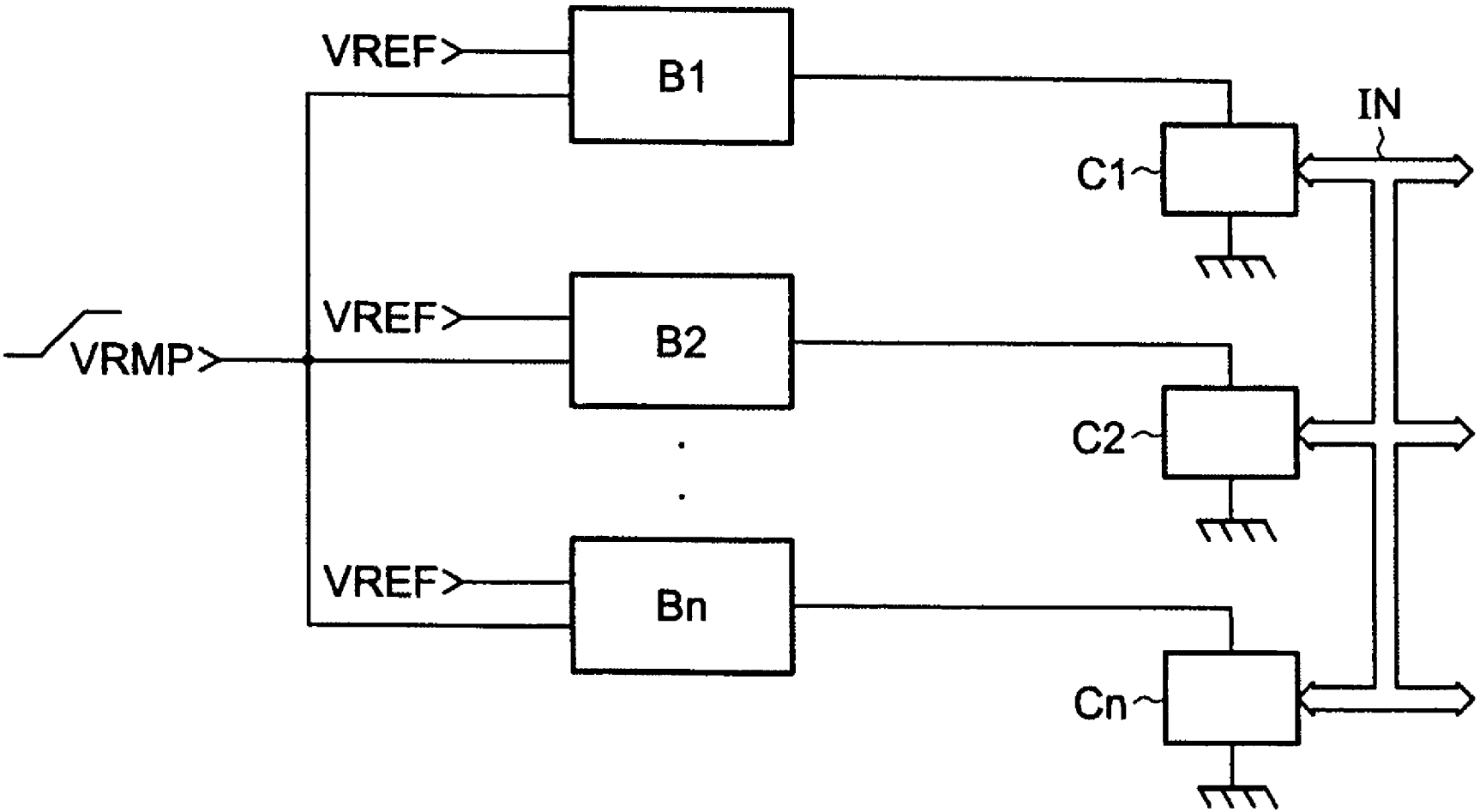
FIG. 5 shows schematically another exemplary embodiment of a circuit according to the present invention.

As illustrated in FIG. 5, the integrated circuit Cl can comprise several assemblies B1, B2, . . . , Bn, each comprising a regulator LDO and its associated control means. These assemblies B1, B2, . . . , Bn are respectively connected to loads C1, C2, . . . , Cn. Interconnections IN may exist between the various loads C1, C2, and Cn. The assemblies B1,B2, . . . , Bn receive the reference voltage $V_{REF}$. They are all connected to the same generation means delivering the substitution voltage $V_{RMP}$.

The start-up phase of the various LDO voltage regulators can thus be controlled simultaneously. The output levels of the various assemblies B1, B2, . . . , Bn are therefore identical allowing the appearance of interference-causing currents, due to conducting parasitic diodes, to be avoided at the interconnections IN.

Although a specific embodiment of the invention has been disclosed, it will be understood by those having skill in the art that changes can be made to this specific embodiment without departing from the spirit and scope of the invention. The scope of the invention is not to be restricted, therefore, to the specific embodiment, and it is intended that the appended claims cover any and all such applications, modifications, and embodiments within the scope of the present invention.

What is claimed is:

1. A method for controlling a regulated output voltage, the method comprising:

delivering a regulated output voltage using a reference voltage via at least one low-dropout voltage regulator;

replacing the reference voltage with a substitution voltage in a form of a ramp, as long as a value of the substitution voltage remains below the reference voltage during a start-up phase for the low-dropout voltage regulator;

coupling an output of the low-dropout voltage regulator to a load that is in parallel with an external capacitor; and adjusting a slope of the ramp of the substitution voltage as a function of a desired current flowing through the external capacitor during the start-up phase.

2. The method according to claim 1, further comprising:

coupling the reference voltage to a first input of a first operational amplifier;

coupling an output of the first operational amplifier back into a second input of the first operational amplifier via a control transistor; and wherein the replacing includes using a second operational amplifier having a first input connected to the substitution voltage, a second input connected to a second input of the first operational amplifier and an output connected to the output of the first amplifier and to a gate of the control transistor.

3. The method according to claim 1, further comprising:

coupling a first input of a first operational amplifier to the reference voltage;

coupling an output of the first operational amplifier back into a second input of the first operational amplifier via a control transistor; and wherein the replacing includes using a comparator capable of comparing the substitution voltage and the reference voltage; and using a switch, connected to the first input of the first operational amplifier, the switch capable of delivering one of the substitution voltage and the reference voltage, depending on an output signal delivered by the comparator.

4. The method according to claim 1, further comprising:

coupling a gate of a first transistor of a first operational amplifier to the reference voltage;

wherein the replacing includes using an additional transistor mounted in parallel with the first transistor of the first operational amplifier, the additional transistor with a gate coupled to the substitution voltage.

5. The method according to claim 2, wherein the first operational amplifier comprises two PMOS input transistors.

6. The method according to claim 3, wherein the first operational amplifier comprises two PMOS input transistors.

7. The method according to claim 4, wherein the first operational amplifier comprises two PMOS input transistors.

8. An integrated circuit for controlling a regulated output voltage, the integrated circuit comprising:

at least one low-dropout voltage regulator capable of delivering a regulated output voltage using a reference voltage, wherein the low-dropout voltage regulator includes:

means for generating a substitution voltage in a form of a ramp; and means for controlling a replacement of the reference voltage by the substitution voltage as long as the substitution voltage is lower than the reference voltage during a start-up phase, wherein an output of the low-dropout voltage regulator is connected to a load that is in parallel with an external capacitor, and wherein a slope of the ramp of the substitution voltage is a function of a desired current flowing through the external capacitor during the start-up phase.

9. The integrated circuit according to claim 8, wherein the low-dropout voltage regulator further comprises:

a first operational amplifier having a first input receiving the reference voltage and an output fed back into a second input of the first operational amplifier via a control transistor; and wherein the control means comprise a second operational amplifier having a first input connected to the output of the means of generating a substitution voltage, a second input connected to a second input of the first operational amplifier and an output connected to the output of the first amplifier and to a gate of the control transistor.

10. The integrated circuit according to claim 8, wherein the low-dropout voltage regulator further comprises:

a first operational amplifier having a first input receiving the reference voltage and an output fed back into a second input of the first operational amplifier via a control transistor; and wherein the control means comprise a second operational amplifier having a first input connected to the output of the means of generating a substitution voltage, a second input connected to a second input of the first operational amplifier and an output connected to the output of the first amplifier and to a gate of the control transistor.

11. The integrated circuit according to claim 8, wherein the low-dropout voltage regulator further comprises:

a first operational amplifier having a first input receiving the reference voltage, and an output fed back into a second input of the first operational amplifier via a control transistor, and wherein in that the control means comprise:

a comparator capable of comparing the substitution voltage and the reference voltage; and a switch, connected to the first input of the first operational amplifier, the switch capable of delivering one of the substitution voltage and the reference voltage, depending on an output signal delivered by the comparator.

12. The integrated circuit according to claim 8, wherein the low-dropout voltage regulator further comprises:

a first operational amplifier having a first input receiving the reference voltage, and an output fed back into a second input of the first operational amplifier via a control transistor, and wherein in that the control means comprise:

a comparator capable of comparing the substitution voltage and the reference voltage; and a switch, connected to the first input of the first operational amplifier, the switch capable of delivering one of the substitution voltage and the reference voltage, depending on an output signal delivered by the comparator.

13. The integrated circuit according to claim 8, wherein the low-dropout voltage regulator further comprises:

a first operational amplifier comprising a first transistor with a gate coupled to the reference voltage;

wherein the control means includes an additional transistor mounted in parallel with the first transistor of the first operational amplifier, the additional transistor with a gate coupled to the substitution voltage.

14. The integrated circuit according to claim 8, wherein the low-dropout voltage regulator further comprises:

a first operational amplifier comprising a first transistor with a gate coupled to the reference voltage;

wherein the control means includes an additional transistor mounted in parallel with the first transistor of the first operational amplifier, the additional transistor with a gate coupled to the substitution voltage.

15. The integrated circuit according to claim 13, wherein the first operational amplifier comprises two PMOS input transistors.

16. The integrated circuit according to claim 14, wherein the first operational amplifier comprises two PMOS input transistors.

* * * * *